US005699564A

United States Patent [19]

Heh

[11] Patent Number: 5,699,564

[45] Date of Patent: Dec. 23, 1997

[54] DETACHABLE ORGANIZING APPARATUS FOR CHILDREN FURNITURE

[76] Inventor: Deborah A. Heh, 25 Brook St., Ocean, N.J. 07712

[21] Appl. No.: 589,459

[22] Filed: Jan. 19, 1996

[51] Int. Cl.[6] ..... A47D 15/00; B65D 21/036; B65D 33/28; B65D 30/26

[52] U.S. Cl. ..... 5/503.1; 5/658; 220/403; 220/404; 383/6; 383/15; 383/111

[58] Field of Search ..... 5/503.1, 658; 220/403, 220/404, 475, 480; 383/6, 11, 15, 22, 24, 111; 248/104, 205.2

[56] References Cited

U.S. PATENT DOCUMENTS

| | | | |
|---|---|---|---|
| D. 343,604 | 1/1994 | Rekow | D12/158 |
| 599,119 | 2/1898 | Coolidge . | |
| 650,632 | 5/1900 | Coolidge . | |
| 752,004 | 2/1904 | Simons . | |
| 1,094,885 | 4/1914 | Dennis . | |
| 1,124,925 | 1/1915 | Low | 383/18 |
| 1,359,329 | 11/1920 | Carson . | |
| 2,724,429 | 11/1955 | Warner | 155/127 |
| 3,400,829 | 9/1968 | Youngson | 211/86 |
| 3,608,712 | 9/1971 | Savoie | 206/525 |
| 3,706,105 | 12/1972 | Nicholas et al. | 5/93 R |
| 3,746,066 | 7/1973 | McIntyre | 383/6 |
| 4,466,659 | 8/1984 | Carpentier et al. | 297/191 |
| 4,824,168 | 4/1989 | Makoski | 297/229 |
| 4,877,288 | 10/1989 | Lee | 297/229 |
| 5,011,221 | 4/1991 | Wise | 297/191 |
| 5,139,308 | 8/1992 | Ziman | 297/191 |
| 5,181,627 | 1/1993 | McDermott et al. | 220/404 |
| 5,226,576 | 7/1993 | Ellsworth | 383/111 |
| 5,314,232 | 5/1994 | Hopkins | 297/191 |
| 5,409,291 | 4/1995 | Lamb et al. | 297/129 |
| 5,411,165 | 5/1995 | Ellis | 220/404 |
| 5,431,317 | 7/1995 | Kliot | 383/15 |
| 5,526,924 | 6/1996 | Klutanick | 383/111 |

*Primary Examiner*—Rodney M. Lindsey
*Assistant Examiner*—Robert G. Santos
*Attorney, Agent, or Firm*—Thomason & Moser

[57] ABSTRACT

A detachable organizing apparatus which is mounted to children furniture for holding and providing easy access to a plurality of children accessories. The detachable organizing apparatus is easily adaptable to a number of different children furniture such as a crib, highchair and playpen. The organizing apparatus comprises an exterior container, a detachable inner liner or bag and a plurality of straps. The straps are generally employed to secure the organizing apparatus to a horizontal member of a children furniture. To effect easy removal of the organizing apparatus, the straps are equipped with quick release clips such as parachute clips. The inner liner is generally constructed from a washable fabric.

5 Claims, 3 Drawing Sheets

DETACHABLE ORGANIZING APPARATUS FOR CHILDREN FURNITURE

FIELD OF THE INVENTION

The present invention relates to a detachable organizing apparatus which is mounted to children furniture for holding a multitude of items. More particularly, the invention relates to a detachable backpack or basket with a detachable inner liner which is mounted to a crib or high chair for holding and providing easy access to a plurality of children accessories.

BACKGROUND OF THE INVENTION

Most parents are aware of the difficulties associated with gathering and providing a variety of items which are required to meet the seemingly constant needs of a child. In order to care for a child, a parent must frequently access essential items such as baby bottles, baby food, diapers, baby wipes, toys, rattles, pacifiers and bibs. Keeping track of these items can be a logistic nightmare.

To further compound the problem, many children furniture such as crib, highchair and playpen often do not provide storage space to hold children accessories. The lack of storage space associated with these children furniture can be attributed to cost, safety concerns, or simply poor designs. It is extremely desirable for a parent to be able to store and access children accessories while caring for a child. Since a child spends a good portion of his or her time each day within one of these children furniture, it is extremely desirable to have a detachable organizer which can be adapted to a plurality of children furniture.

Furthermore, most parents are well aware of the problems associated with traveling with small children. The parent must now track as well as gather all the essential items necessary to effect a successful excursion. Thus, it is extremely desirable for a parent to be able to quickly access a pre-assembled organizer with the basic travel items without having to start a gathering process for every excursion.

Furthermore, due to the unpredictable and rambunctious nature of a small child, a parent quickly realizes that any items that come in contact with the child will likely become soiled. Thus, it is extremely desirable for a parent to be able to wash a detachable organizer as well.

Over the years, various devices have been developed to address this problem. An example of such a device is described in U.S. Pat. No. 5,314,232 issued on May 24, 1994 to David Hopkins. Hopkins discloses a highchair pouch having various article containment members. The pouch is created by attaching a rectangular member to the back of a highchair to define a pouch. One side of the rectangular member is left unattached to define an opening to the pouch. Such "kangaroo" pouch is often employed in the back of a seat of a motor vehicle. However, this device becomes non-functional when applied to a highchair with a substantially non-solid back. Furthermore, when the rectangular member is removed from the back of the highchair, the device loses its holding capacity.

Another device is described in U.S. Pat. No. 4,824,168 issued on Apr. 25, 1977 to Kathyrn J. Makoski. Makoski discloses a stroller organizing apparatus which drapes over the back of a stroller. The device contains a seat segment and a back segment having a plurality of pockets. However, the seat segment of this device becomes an obstruction when applied to other children furniture. Furthermore, the stroller organizing apparatus is cumbersome when used as a travel organizer without the stroller.

Therefore, a need exists in the art for a detachable organizing apparatus with a detachable inner liner which is mounted to children furniture for holding and providing easy access to a plurality of children accessories.

SUMMARY OF THE INVENTION

The present invention is a detachable organizing apparatus which is mounted to children furniture for holding and providing easy access to a plurality of children accessories. The detachable organizing apparatus is easily adaptable to a number of different children furniture such as a crib, highchair and playpen.

The organizing apparatus comprises an exterior container, an inner liner or bag and a plurality of straps. The straps are generally employed to secure the organizing apparatus to a horizontal member of a children furniture. To effect easy removal of the organizing apparatus, the straps are equipped with quick release clips such as parachute clips.

The exterior container can be constructed from a number of different materials such as plastic, wicker, light weight metal, wood or a pliable fabric. Although the exterior container is detachable, it generally serves as a stationary storage container.

Conversely, the inner liner is detachable from the exterior container and serves as a travel organizer. This configuration permits a parent to easily detach the inner liner from the exterior container for traveling purposes without having to repack all the items again. Furthermore, the inner liner is generally constructed from a washable fabric, thereby permitting the inner liner to be washed.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

Figure 1:
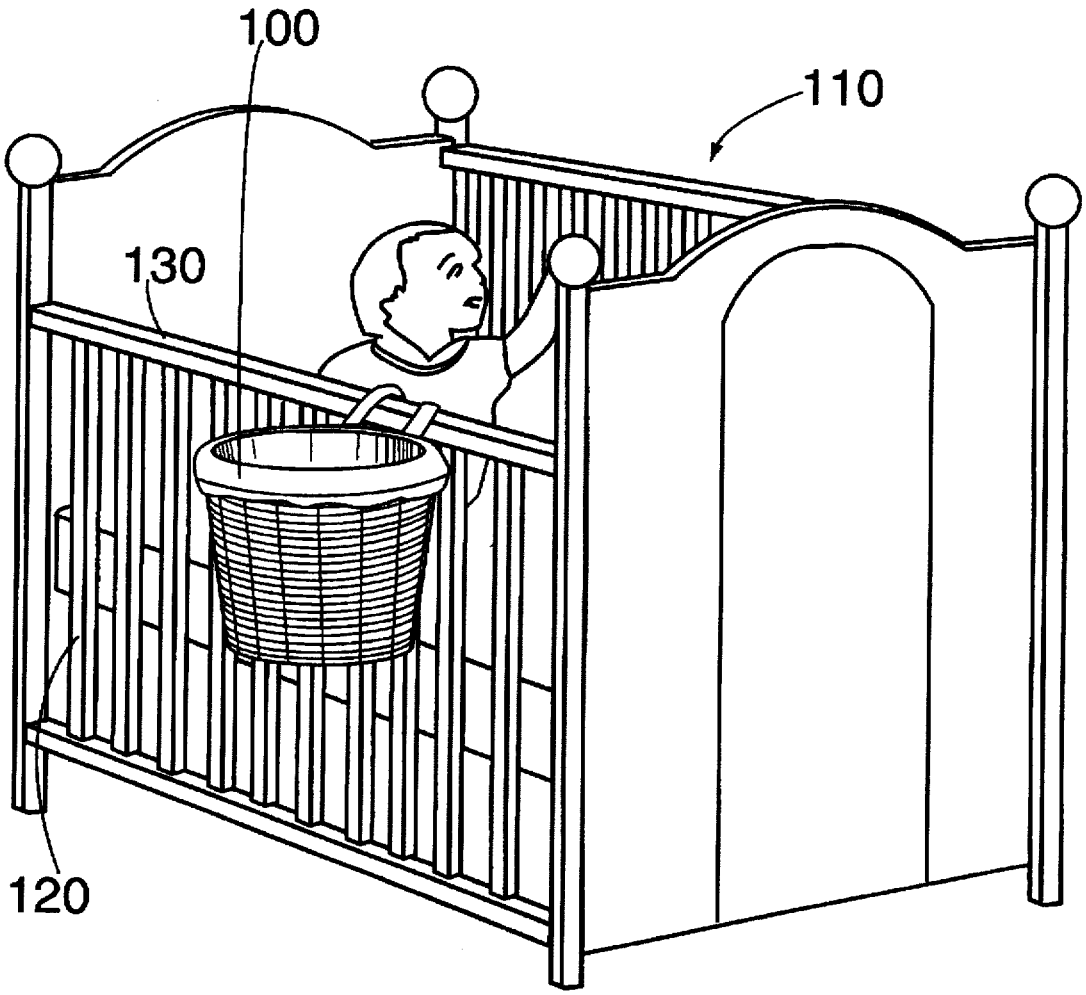
FIG. 1 illustrates a perspective view of a crib on which the present invention has been installed.

FIG. 1 depicts a perspective view of the detachable organizing apparatus (organizer) 100 of the present invention mounted to a crib 110. FIG. 1 also illustrates one configuration of the present invention in which the detachable organizing apparatus is installed to provide easy access to a child within the crib. This permits a child to easily retrieve items such as toys and pacifiers stored in the detachable organizing apparatus.

Figure 2:
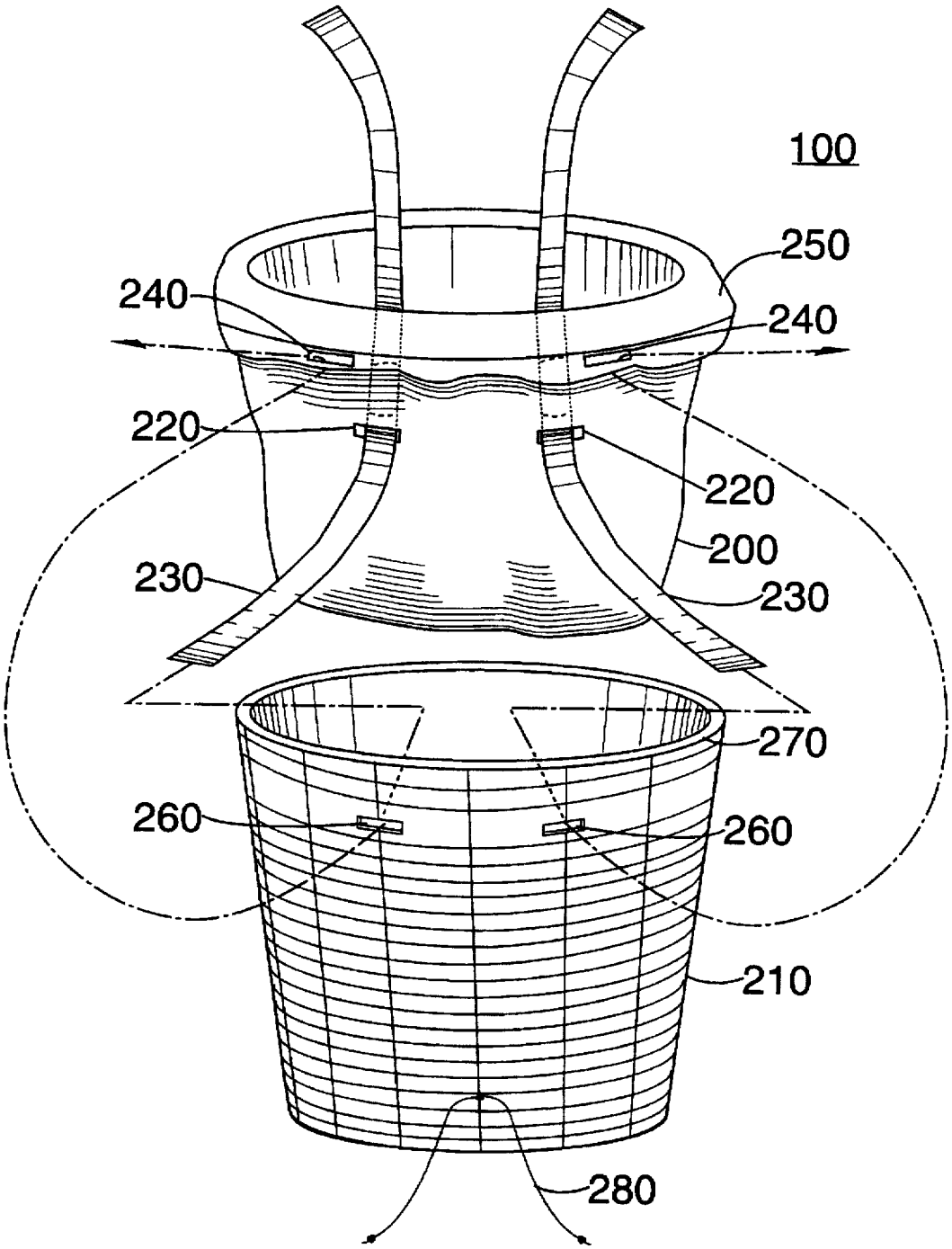
FIG. 2 illustrates an exploded view of a first embodiment of the present invention as shown in FIG. 1.

Specifically, the organizer is mounted to an upper horizontal member 130 of the crib by a plurality of straps (shown in FIG. 2). The straps are looped over the horizontal member 130 and returned to the organizer 100 between vertical members or spindles 120 of the crib. The straps may incorporate quick release clips or are neatly secured to other straps within the organizer. In this fashion, the straps secure the organizer to the crib while minimizing the hazard of allowing a child to detach the organizer from the crib.

Furthermore, those skilled in the art will realize that the organizer 100 of the present invention can be adapted to a number of different children furniture such as a playpen and highchair. The use of a crib in describing the present invention is only illustrative.

FIG. 2 depicts an exploded view of a first preferred embodiment of the present invention as shown in FIG. 1. The organizer 100 comprises an exterior container 210 and an inner liner or bag 200. In the preferred embodiment of the present invention, the exterior container 210 is a wicker basket having an anchor cord 280. However, the exterior container can be constructed from other suitable material such as plastic, wood or light weight metal. The size of the exterior container can be suitably selected to provide a particular storage need. In the preferred embodiment, the oval-shaped wicker basket measures suitably about 14 inches×11 inches×8 inches. The exterior container 210 further comprises a pair of apertures 260 for receiving a pair of straps 230 for securing the exterior container to the crib 110 which is described below.

The inner liner or bag 200 further comprises a plurality of straps 230, a cover flap 250 and apertures 220 and 240. In the preferred embodiment, the inner liner is constructed from a washable fabric which is dryer safe. The inner liner measures approximately 14 inches×11 inches×10 inches.

The inner liner 200 incorporates a tying system that employs two straps 230. Straps 230 are attached to an interior surface of the inner liner as illustrated in FIG. 2. The straps 230 measure suitably about 14 inches in length and 1 inch in width.

In use, the inner liner 200 is deposited within the exterior container 210 with the cover flap 250 covering the rim 270 of the exterior container. The cover flap 250 serves to protect a child from any sharp edges that may extend from the rim of the exterior container. Although the length of the cover flap can be suitably selected to provide substantial coverage of the exterior surfaces of the exterior container, the length of the cover flap measures approximately 1½ inches to 2 inches in the preferred embodiment.

With the inner liner 200 seated with the exterior container 210, straps 230 are initially received into apertures 220 as shown in FIG. 2. The straps 230 are then received into the cavity of the exterior container through apertures 260 of the exterior container and apertures 240 of the inner liner. Apertures 240 are located on the cover flap 250 of the inner liner. In this configuration, the inner liner is firmly secured to the exterior container while the cover flap 250 is held in position over the rim of the exterior container. The straps 230 are looped over a horizontal bar of a children furniture such as the crib as shown in FIG. 1 and is returned to the exterior container 210 between vertical members 120 of the crib. The two ends of the straps 230 are then neatly tied together to secure the organizer to the crib. In this fashion, the straps are conveniently stored within the organizer, thereby minimizing the likelihood of allowing a child to detach the organizer from the crib. Finally, the anchor cord 280 which measures approximately 6 inches, is secured to a vertical member 120 to fasten the lower portion of the exterior container 210 to the crib.

Although the present invention is described with only two straps, any number of straps can be employed to secure the present invention to the crib.

Figure 3:
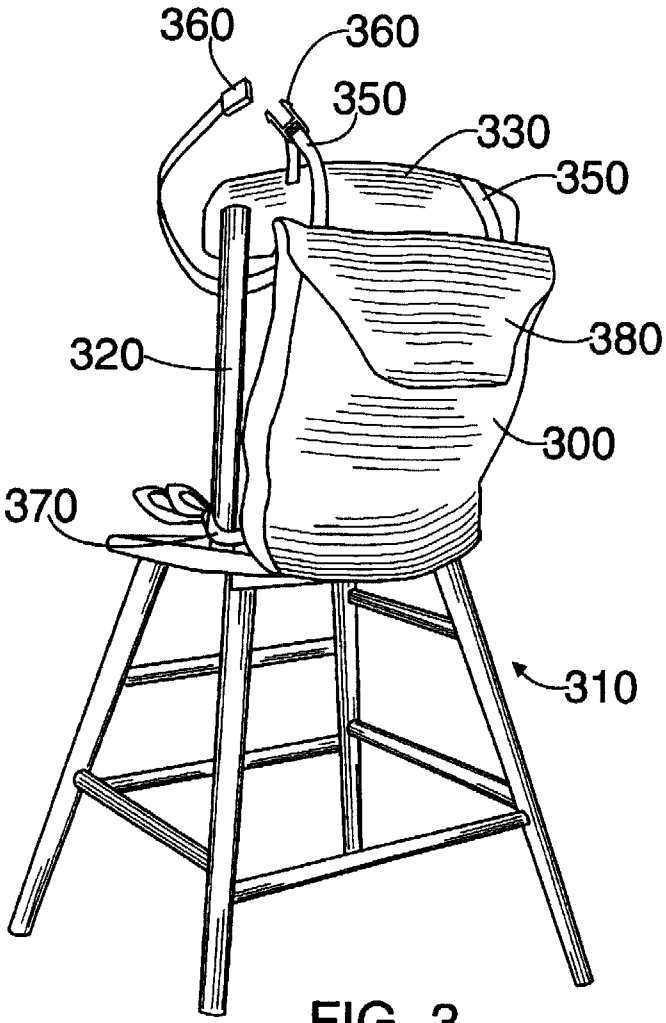
FIG. 3 illustrates a perspective view of a highchair on which the present invention has been installed.

FIG. 3 depicts a perspective view of a second embodiment of the organizer 300 of the present invention mounted to a highchair 310. FIG. 3 also illustrates another configuration of the present invention where the organizer is installed in a manner that provides easy access to a parent who is caring for a child within the highchair. A parent may easily retrieve items such as toys, pacifiers and children utensils which are conveniently stored in the back of the highchair while feeding a small child or simply keeping the child preoccupied in the highchair while the parent is busy.

Specifically, the organizer 300 is mounted to an upper horizontal member 330 of the highchair by a plurality of straps 350. The straps 350 are looped over the horizontal member 330 and returned to the organizer 300 between vertical members 320 of the highchair. The straps 350 may incorporate quick release clips such as parachute clips 360 to allow for length adjustment so that the organizer can be adapted to any highchair. Alternatively, straps 350 can be neatly secured to other straps (not shown) which are coupled to the organizer. In this fashion, the straps 350 secure the organizer to the highchair while minimizing the hazard of allowing a child to detach the organizer from the highchair. The straps 350 measure approximately 16 inches in length and 1 inch in width in the preferred embodiment.

Again, those skilled in the art will realize that the organizer 300 of the present invention can be adapted to a number of different children furniture such as a playpen and crib. The use of a highchair in describing the present invention is only illustrative.

Figure 4:
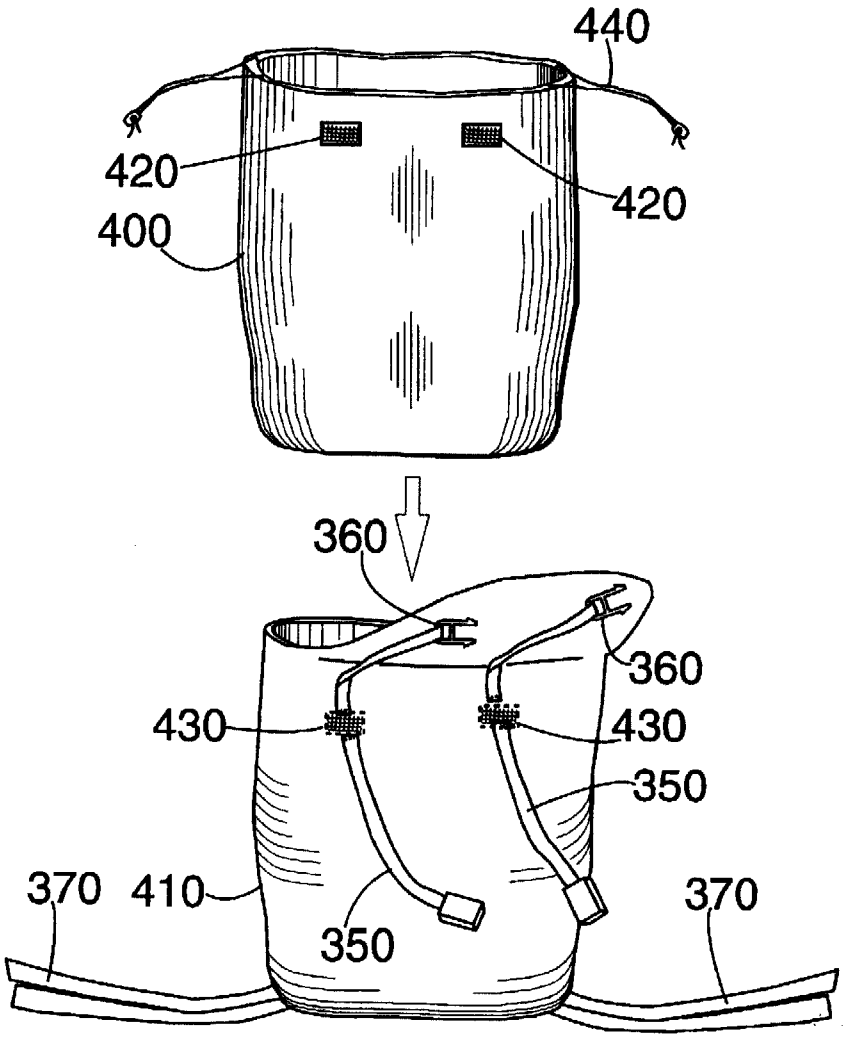
FIG. 4 illustrates an exploded view of a second embodiment of the present invention as shown in FIG. 3.

FIG. 4 depicts an exploded view of the second preferred embodiment of the present invention as shown in FIG. 3. The organizer 300 comprises an exterior container 410 and an inner liner or bag 400.

In the preferred embodiment of the present invention, the exterior container 410 is a backpack constructed from a washable fabric. However, the exterior container can be constructed from other suitable material such as plastic, nylon or leather. The size of the exterior container 410 can be suitably selected to provide a particular storage need. In the preferred embodiment, the size of the exterior container measures approximately 16 inches×16 inches×4½ inches.

The exterior container 410 comprises an overlapping flap 380, straps 350 with clips 360, lower straps 370 and strip mounting members 430. In use, the straps 350 are used to secure the organizer 300 to an upper horizontal member of a children furniture as described above. Once secured, the lower straps 370 extending from a lower portion of the exterior container are used to neatly fasten the lower portion of the exterior container to the highchair. The lower straps 370 prevents the organizer from swinging as the highchair is moved about. The straps 370 measure approximately 20 inches in length and 1 inch in width in the preferred embodiment. Finally, the overlapping flap 380 utilizes a closure strip (not shown) for closing the exterior container. Such closure strip or strip mounting members may comprise mounting material as marketed under the VELCRO® trademark. With the exterior container secured to the highchair, the inner liner 400 is inserted into the exterior container 410.

The inner liner 400 is constructed from a washable fabric and further comprises strip mounting members (Velcro strip) 420 and a draw string 440. The inner liner measures approximately 15¾ inches×15¾ inches×4 inches. In use, the strip mounting members 420 are coupled with the strip mounting members 430 of the exterior containers for securing the inner liner 400 to the exterior container. With the inner liner seated within the exterior container, the draw string 440 can be applied to close the inner liner of the organizer 300.

In this configuration, a parent may easily extract the inner liner 400 with its entire content for traveling purposes. Thus, the inner liner of the organizer serves as a detachable travel bag, thereby eliminating the need to repack the items into another travel pack.

Again, although the present invention is described with only two sets of straps including parachute clips, the present invention may incorporate any number of straps with or without clipping mechanisms such as parachute clips, latches or buckles for securing the present invention. Furthermore, the straps can be constructed from materials such as fabric, strings or nylon cords.

There has thus been shown and described a novel detachable organizing apparatus which is mounted to children furniture for holding and providing easy access to a plurality of children accessories. Many changes, modifications, variations and other uses and applications of the subject invention will, however, become apparent to those skilled in the art after considering this specification and the accompanying drawings which disclose the embodiments thereof. All such changes, modifications, variations and other uses and applications which do not depart from the spirit and scope of the invention are deemed to be covered by the invention, which is to be limited only by the claims which follow.

What is claimed is:

1. A detachable organizing apparatus for children furniture, said apparatus comprising:

exterior holding means having a first aperture;

interior detachable holding means, disposed within said exterior holding means, for receiving a plurality of children accessories; and securing means, coupled to said interior holding means, for securing said exterior holding means to the children furniture, wherein said interior detachable holding means comprises a bag having a second aperture and a cover flap extending from a edge of said bag for covering a rim of said exterior holding means; and wherein said securing means comprises a first strap having two ends, coupled to an interior surface of said bag, where said first strap is for attachment to said children furniture, where said first strap is received through said first aperture and said second aperture for securing said exterior holding means to the children furniture by tying said two ends of said first strap.

2. The apparatus of claim 1, wherein said cover flap includes a third aperture for receiving said first strap for securing said cover flap to said exterior holding means.

3. The apparatus of claim 1, further comprises a parachute clip assembly coupled to said ends of said first strap.

4. The apparatus of claim 1, wherein said bag farther comprises a draw string for closing said bag.

5. The apparatus of claim 1, wherein said exterior holding means includes a second strap for attachment to said children furniture.

* * * * *